US005316057A

United States Patent [19]

Hasselmann

[11] Patent Number: 5,316,057

[45] Date of Patent: May 31, 1994

[54] VAPOR RECOVERY SYSTEM TESTER

[76] Inventor: Detlev E. M. Hasselmann, 519 S. Nardo, Solana Beach, Calif. 92075

[21] Appl. No.: 53,775

[22] Filed: Apr. 28, 1993

[51] Int. Cl.[5] ..... B65B 1/30; B65B 31/00; B65B 3/00

[52] U.S. Cl. ..... 141/94; 141/392; 285/133.1; 73/40.5 R

[58] Field of Search ..... 73/40.5, 168, 198, 23.2, 73/865.9, 863.81, 864.33, 40, 49.1, 49.3, 52; 141/93, 94, 96, 392, 44, 46, 59, 83, 95; 285/93, 97, 104, 13, 133.1

[56] References Cited

U.S. PATENT DOCUMENTS

| | | | |
|---|---|---|---|
| 2,063,696 | 12/1936 | Oxley | 141/96 |
| 2,138,379 | 11/1938 | Killman | 141/96 |
| 2,850,049 | 9/1958 | Lomax | 141/95 |
| 4,138,880 | 2/1979 | Cohen et al. | 73/23 |
| 4,932,257 | 6/1990 | Webb | 285/133.1 |
| 5,054,523 | 10/1991 | Rink | 285/133.1 |
| 5,129,432 | 7/1992 | Dugger | 141/44 |

*Primary Examiner*—Ernest G. Cusick
*Assistant Examiner*—Steven O. Douglas
*Attorney, Agent, or Firm*—Baker, Maxham, Jester & Meador

[57] ABSTRACT

An apparatus for testing the efficiency of the vapor recovery of a liquid dispensing and vapor recovery system wherein the system uses a spout with vapor recovery apertures. The apparatus includes a device for receiving the spout and its vapor recovery apertures with a space located therebetween. A sealing device is connected to the spout receiving device for providing a chamber which is sealed about the spout and vapor recovery apertures. A device is connected to the spout receiving device for responding to flow through the chamber about the vapor recovery apertures. With this arrangement the volume of air recovered can be determined and compared with the volume of liquid dispensed to indicate the efficiency of the vapor recovery system.

19 Claims, 4 Drawing Sheets

FIG. 1
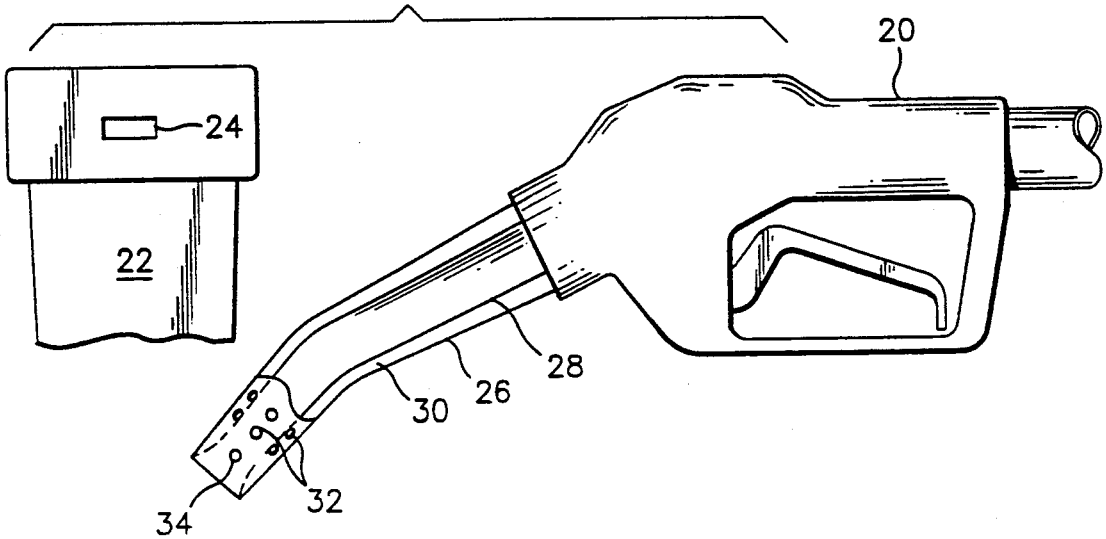
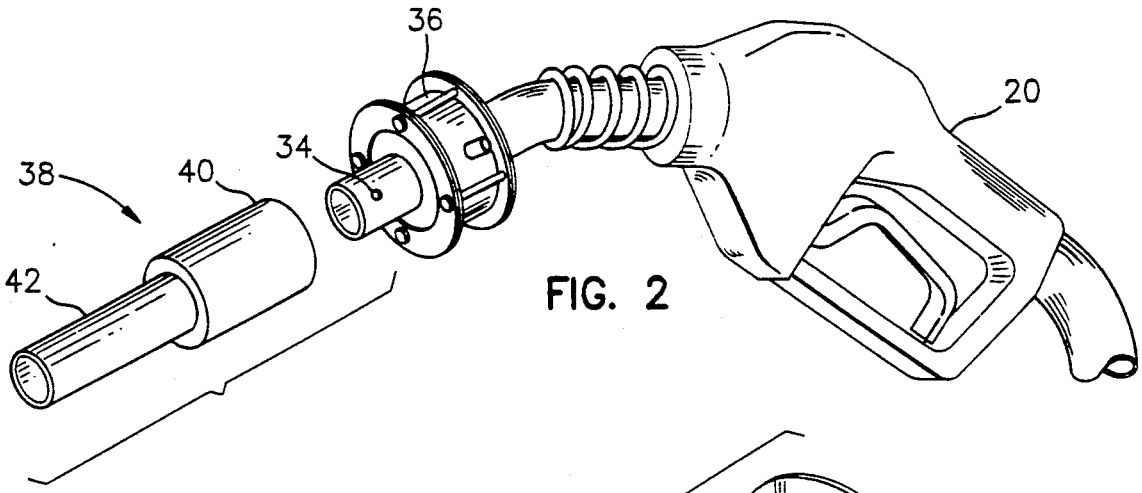
FIG. 2
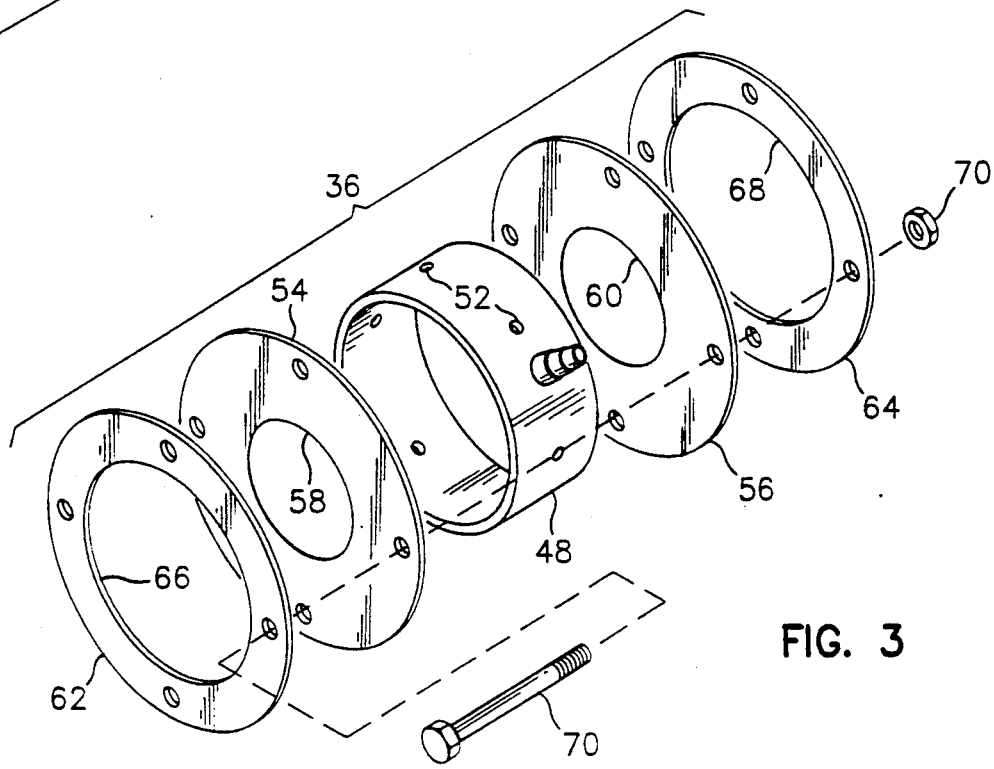
FIG. 3

FIG. 4
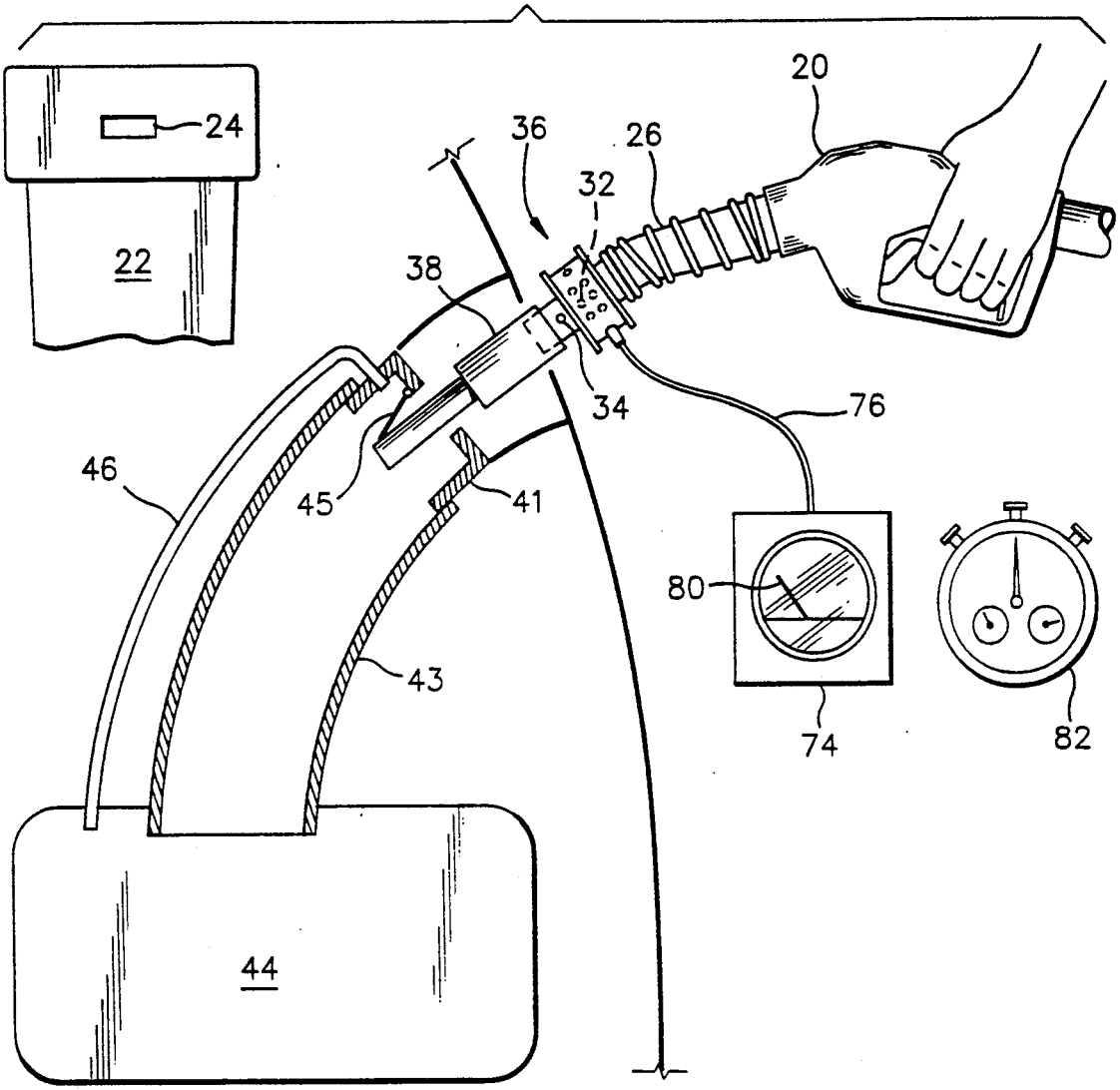
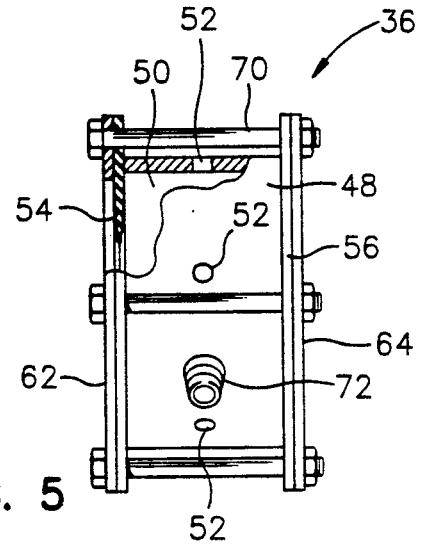
FIG. 5
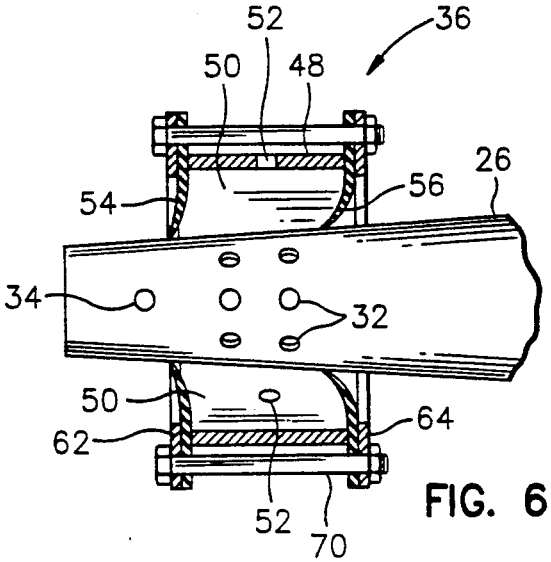
FIG. 6

FIG. 7
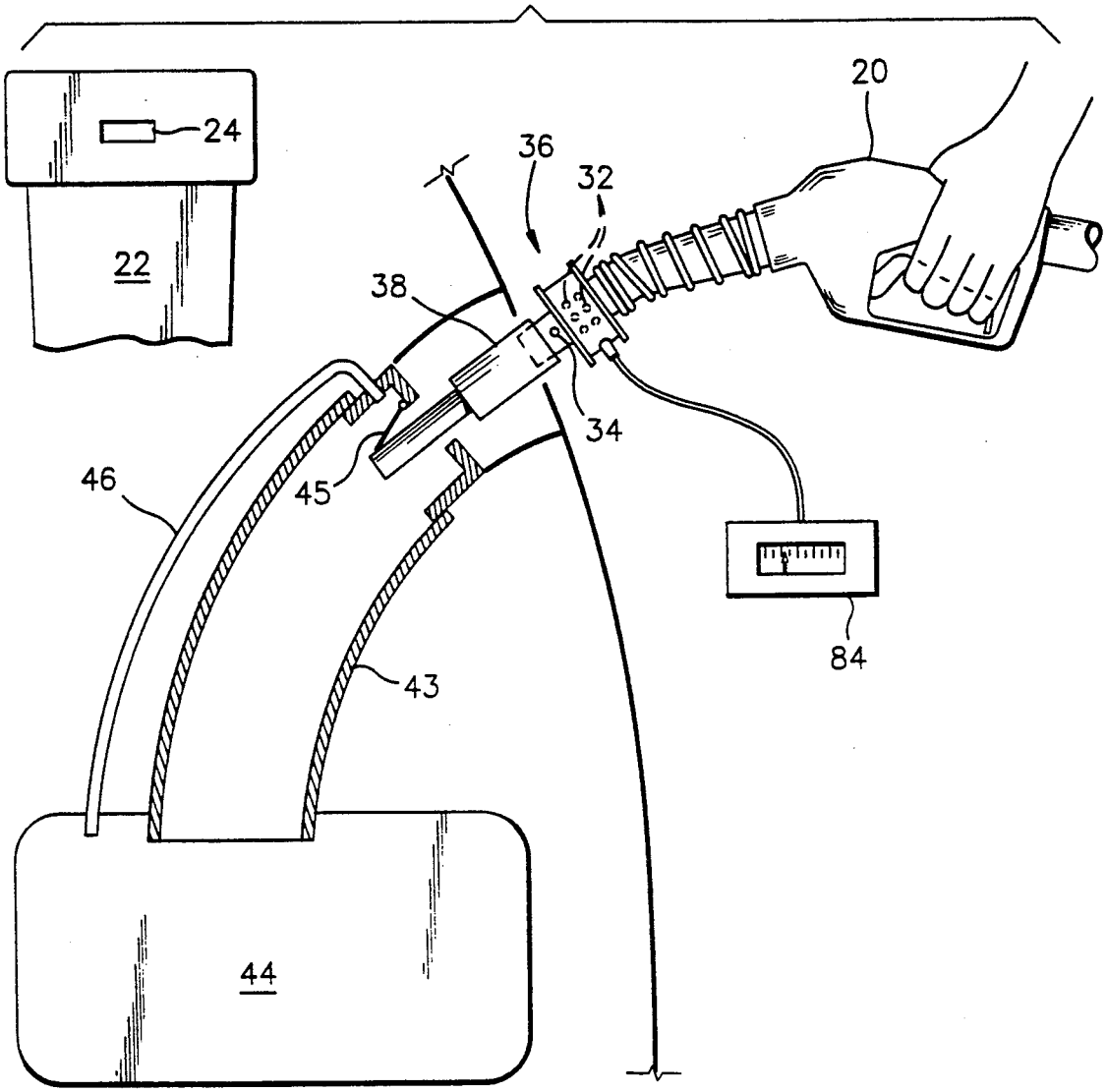
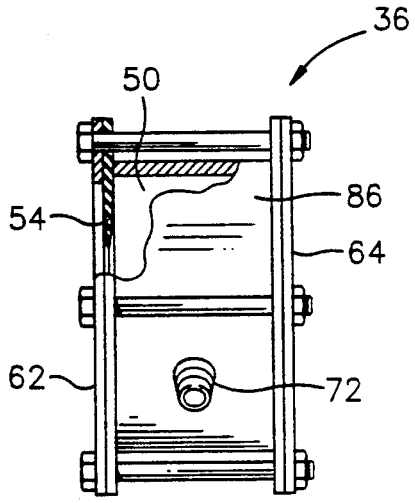
FIG. 8
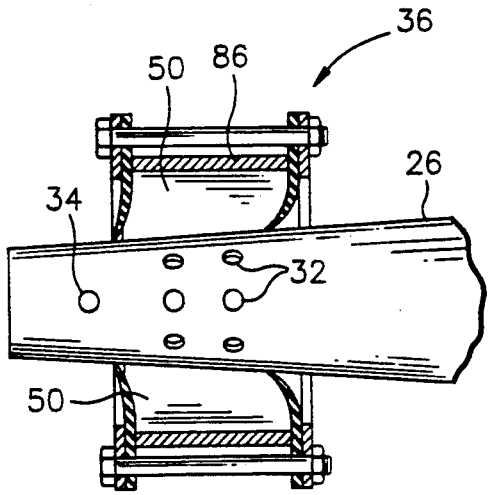
FIG. 9

VAPOR RECOVERY SYSTEM TESTER

BACKGROUND OF THE INVENTION

1. Field of the Invention

The invention relates to a device for testing the efficiency of a vapor recovery system, such as that employed with a gasoline dispensing system.

2. Discussion of the Related Art

One form of pollution is gasoline vapors that escape during re-fueling of a vehicle. When gasoline is dispensed into a vehicle, such as an automobile, the gasoline displaces the gaseous vapors in the gasoline tank. This causes the gaseous vapors to vent to the atmosphere. In some instances, these vapors make their way upwardly through the fill tube. However, in most instances, the manufacturer provides a separate tube between the tank and the fill neck for venting the vapors. Because of the potential for pollution caused by re-fueling vehicles, governmental regulations have required many geographical locations to provide a gasoline dispensing system which collects the vapors as the gasoline is dispensed. Within the gasoline dispensing system is a gasoline vapor recovery system which utilizes a vacuum to recover the vapors at the fill neck of the vehicle. This is accomplished by a gasoline nozzle which has a concentric spout, the concentric spout providing a vapor passageway around the liquid dispensing passageway. Apertures near the distal end of the outer spout allow the gaseous vapors to be vacuumed into the vapor passageway and returned to the underground gasoline supply tank. In many locations, government regulations establish acceptable performance levels for the gasoline vapor recovery system. Various tests have been established to check the efficiency performance of an individual vapor recovery system. These tests determine the ratio of the volume of the gasoline vapors recovered to the volume of the gasoline liquid dispensed which is referred to as the V/L ratio. If this ratio is one, for instance, then it can be said that a cubic foot of gasoline vapor is returned for every cubic foot of gasoline dispensed. This ratio is a key indicator of the performance of the vapor recovery system. Government regulations set an acceptable range of V/L ratios based upon measurements made during certification testing. In some areas, government regulations also establish a separate test for determining whether there is a blockage of the vapor recovery system.

The present testing devices for determining the V/L ratio are very bulky and require a considerable amount of time and effort to connect to a vapor recovery system. These devices are also very invasive of the gasoline dispensing system and create a spectacle which arouses curiosity. The use of these devices invariably require the vapor return hose to be broken and a large flow meter installed in the vapor return path. A bucket to hold the dispensed gasoline is also required. The gasoline then has to be disposed of by pouring it into the underground storage tank.

There is a need for a testing device which is compact, for example, briefcase size, and which can quickly test for the V/L ratio with minimal effort. Further, there is a need for a test device which will require no hauling or dumping of gasoline which is dispensed during the test.

SUMMARY OF THE INVENTION

The present invention has overcome the aforementioned problems associated with prior art vapor recovery system testing devices by providing a testing device which is very compact and which can quickly test for the V/L efficiency ratio without major invasion on the system being tested. The invention also enables the testing device to be utilized while re-fueling a vehicle so that there is no requirement for hauling or dumping of the gasoline dispensed. This has been accomplished by providing a device which is slipped over the vapor recovery spout of the liquid dispensing nozzle to be tested. The spout has the aforementioned apertures through which the gasoline vapors are vacuumed into a passageway and then returned to the gasoline storage tank. The present invention provides a device for receiving and encompassing the spout and its gasoline vapor recovery apertures with a space located about the spout and its vapor recovery apertures. The receiving device is sealed to the spout so as to provide a sealed chamber about the gasoline vapor recovery apertures. A tube may then be connected to the spout receiving device for communicating the space in the chamber to a flow measurement device, such as a positive displacement air volume meter. The volume of air flow shown by the meter indicates the volume of gasoline vapor recovered by the system. With the volume of air flow and the indicated volume of gasoline dispensed, the V/L ratio can be determined to indicate the performance of the vapor recovery system. The V/L ratio will also indicate whether there is a blockage in the vapor recovery system. Accordingly, separate government regulated tests for system blockage are no longer required. In some embodiments of the invention, the lapsed time of dispensing the gasoline may be required to establish the V/L ratio.

While the invention has been described for use with vapor recovery systems for gasoline dispensing, it should be realized that the invention can be practiced with a vapor recovery system for any liquid dispensing type of system.

An object of the present invention is to overcome the aforementioned problems associated with prior art devices for testing a vapor recovery system.

A further object is to provide a lightweight and compact testing device which can be easily used to test the V/L ratio of a vapor recovery system without major invasion of the system being tested.

Another object is to accomplish the aforementioned object while re-fueling a vehicle.

Still another object is to provide a device for testing a vapor recovery system which is easy to manufacture and which can be used by an operator who desires to keep a low profile.

Still a further object is to provide a method of easily determining the V/L ratio of a vapor recovery system.

BRIEF DESCRIPTION OF THE DRAWING

The objects, advantages, and features of this invention will be more readily understood from the following detailed description, when read in conjunction with the accompanying drawing, in which:

FIG. 1 is a schematic illustration of a nozzle for a gasoline dispensing system;

FIG. 2 is an isometric view of a gasoline dispensing nozzle in combination with certain elements of the invention;

FIG. 3 is an exploded isometric view of a test sleeve portion of the invention;

FIG. 4 is a schematic illustration of one embodiment of the present invention for establishing the V/L ratio;

FIG. 5 is a side view of a test sleeve portion of the invention with a portion broken away to illustrate various details thereof;

FIG. 6 is a cross-sectional side view of the sleeve inserted over the spout of a gasoline nozzle;

FIG. 7 is a schematic illustration of another embodiment of the present invention for establishing the V/L ratio;

FIG. 8 is a side view of the embodiment of the test sleeve in FIG. 7 with a portion cut away to illustrate various details thereof;

FIG. 9 is a cross-sectional side view of the embodiment of the test sleeve in FIG. 7 inserted over the spout of a gasoline nozzle;

DETAILED DESCRIPTION OF THE PREFERRED EMBODIMENTS

Figure 10:
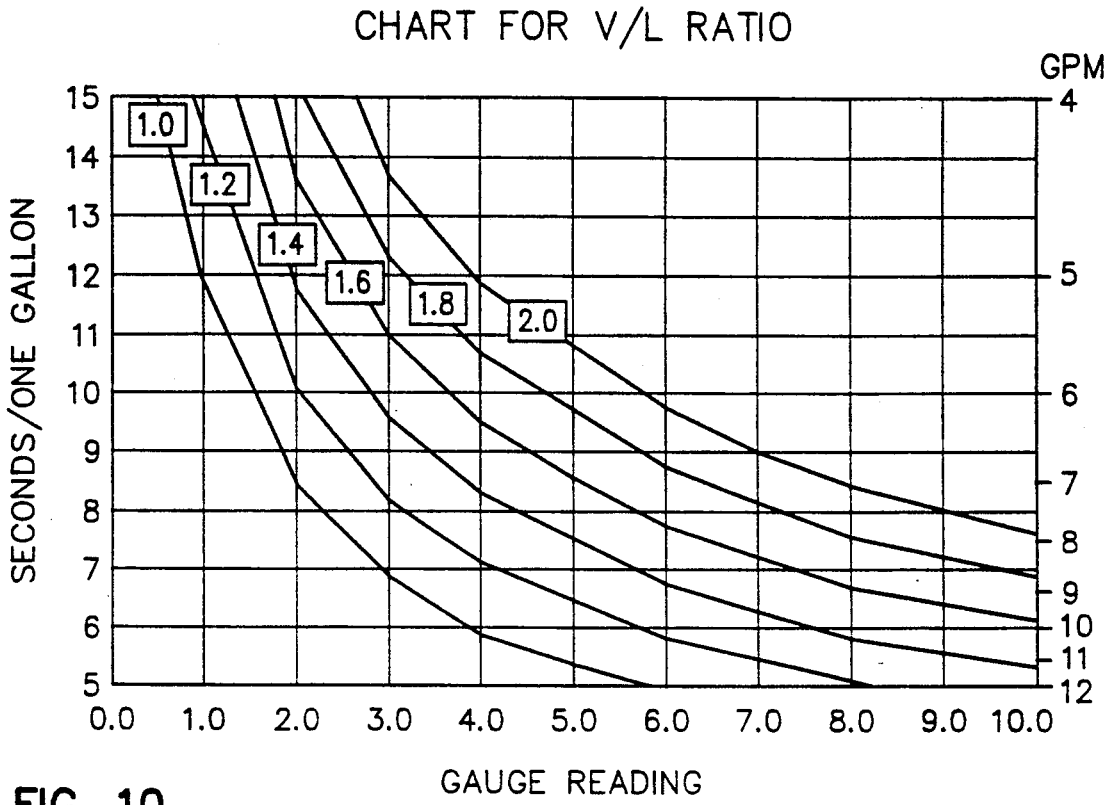
FIG. 10 is a chart which illustrates V/L ratios for various air pressure differential gauge readings versus gallons per minute of gasoline dispensed.

Referring now to the drawing wherein like reference numerals designate like or similar parts throughout the several views, there is illustrated in FIG. 1 a gasoline nozzle 20 for a gasoline dispensing system 22, the latter system having an indicator 24 to show the volume of gasoline dispensed. It should be understood that all references to gasoline are only exemplary since the invention to be described can be used for any liquid dispensing system which contains a vapor recovery system. The nozzle 20 has a pair of co-axial spouts 26 and 28 which are closed at their distal ends to form an annular passageway 30. The outer spout is provided with a plurality of apertures 32 so that vapors outside the spout can be drawn into the passageway 30 by a vacuum device (not shown) which is part of the gasoline dispensing system 22. The vapors are then directed to the underground storage tank (not shown) or processed for disposal purposes. It is the vacuum device in combination with the passageway 30 and apertures 32 that form what is commonly called the "vapor recovery system". As shown in FIG. 1, the outer spout 26 is provided with an automatic shut-off port 34. A tube (not shown) connects this port to a device for automatically shutting off the nozzle 20 when gasoline impinges on the port.

The performance of the aforementioned vapor recovery system can be checked by determining the volume of vapors recovered with respect to the volume of gasoline dispensed. This is known as the V/L ratio which also indicates whether the system has any liquid blockage. Various V/L ratios from 1.0 to 2.0 are illustrated in the chart of FIG. 10 which will be discussed in more detail hereinafter. If, for instance, the V/L ratio is 1.0, this means that the volume of vapors recovered is the same as the volume of the gasoline dispensed. In many cases, however, the V/L ratio is larger than one because there is not a tight seal at the fill neck. Consequently the nozzle will ingest some air in addition to the volume corresponding to volume of gasoline dispensed. Recovery of this vapor during refueling of a vehicle is very important to prevent pollution of the atmosphere.

In FIG. 2 there is illustrated a test sleeve portion 36 of the invention inserted on the gasoline spout 26 so as to provide a sealed compartment about the vapor recovery apertures 32. Also shown in FIG. 2 is a spout extender 38 which has a tubular portion 40 for receiving the distal end of the outer spout 26 and a smaller tubular portion 42 which can be inserted into the fill neck of a gasoline tank. The tubular portion 40 of the spout extender 38 may be made of a pliable material, such as rubber, so as to make a good seal with the end of the spout 26.

FIG. 4, 5 and 6 illustrate details of one embodiment of the present invention. With the test sleeve 36 and the extender 38 inserted on the spout 26, as shown in FIG. 4, gasoline can be dispensed by the nozzle 20 through a fill neck 41 and a main tube 43 into the gasoline tank 44. When the extender 38 is inserted in the main tube 43 it opens a spring biased door 45 while the test sleeve 36 remains outside the vehicle. It is important that the test sleeve 36 and the extender 38 be inserted on the spout so that the automatic shut-off port 34 is clear to perform its function. During the test, the spout 26 is normally inserted far enough into the fill neck 41 so that an overflow of gasoline will impinge on the shut-off port 34 to shut off the system. Vapor displaced within the tank 44 is vented to the fill neck 41 via the tube 46. Under normal dispensing of gasoline, the vapors would be recovered by the vapor recovery system through the spout apertures 32. In the setup of FIG. 4, these vapors are not captured since the test sleeve 36 has sealed these apertures 32 in a compartment which provides information on the performance of the vapor recovery system.

The test sleeve 36 of FIG. 4 is shown in more detail in FIGS. 3, 5, and 6. The test sleeve 36 may include a hollow cylinder 48 which is adapted to receive the spout 26 and its vapor recovery apertures 32 with a space 50 located about the spout 26 and its vapor recovery apertures 32. In this particular embodiment, the cylinder 48 is provided with apertures 52 for a allowing ambient air (gas) to be drawn into the chamber 50. The cylinder 48 may be a short section of metal or plastic tubing.

As shown in FIG. 6, means are connected to the cylinder 48 for sealing it to the spout 26 and for providing a sealed chamber 50 about the vapor recovery apertures 32. The sealing means may include a pair of annular sealing diaphragms 54 and 56 which have central openings 58 and 60, respectively (FIG. 3), for receiving the spout in a tight sealing engagement. A tight seal is obtained by sizing the openings 58 and 60 slightly smaller than the spout 26. In order to provide an improved seal, each diaphragm 54 and 56 may taper inwardly toward its inner circumference so that when the test sleeve 36 is inserted on the spout, it easily wipes along the exterior spout surface to make good sealing engagement therewith. These features are illustrated in FIG. 6. The test sleeve 36 may further include annular end plates 62 and 64 which have central openings 66 and 68 respectively, these openings being larger than the spout 26, but preferably smaller than the opening of the cylinder 48. The diaphragms 54 and 56 and the plates 62 and 64 are provided with apertures to receive fasteners, such as bolt and nut combinations 70. When these bolt and nut combinations are tightened, the diaphragms 54 and 56 are sandwiched between respective ends of the cylinder 48 and the end plates 62 and 64 to provide an integral unit, as illustrated in FIG. 5. It should be understood that this is an exemplary embodiment of the sealing means for the test sleeve 36. There are many other ways to mount a pair of sealing members, such as 0-rings or inflatable bladders, to provide the desired chamber 50.

As illustrated in FIG. 5, a fitting 72 is threaded through the cylinder 48 into the chamber 50. With this arrangement the space within the chamber 50 can be communicated to a vacuum measurement means, such as a pressure differential meter 74 (FIG. 4). With a proper fitting on the meter 74, a piece of quarter-inch plastic tubing 76 can be utilized for connecting the meter 74 to the test sleeve 36. The fitting 72 and the tubing 76 then provide a means for communicating the chamber space 50 with the meter 74.

The apertures allow ambient air to be drawn into the chamber 50 during gasoline dispensing. The sleeve 36 with apertures 52 and the meter 74 then become an orifice type flow meter. The meter 74 indicates the relative or differential pressure between the chamber 50 and the atmosphere as a function of ambient air flow through the apertures 52. Differential pressure indications are registered on the gauge 80 of the meter which are dependent upon ambient air flow and which are related to gasoline vapor flow. Accordingly, the meter 74 has to be calibrated for the particular number and size of apertures 52 in the cylinder 48.

To practice the embodiment of the invention illustrated in FIGS. 4, 5 and 6, the operator will employ the meter 74, a stop watch 82 and the gauge 24 of the gasoline pump 22. To carry out the procedure, the operator starts dispensing gasoline at a full open flow. At a predetermined gallon reading, indicated by the meter 24, the operator starts the stop watch 82. When the meter 24 indicates one gallon more than the initial reading the operator stops the stop watch 82. The stop watch will then indicate elapsed time for one gallon. During the dispensing period, the operator will note the reading of the gauge 80. With the gauge reading and the elapsed time reading, the chart in FIG. 10 can be utilized to determine the V/L ratio. The chart in FIG. 10, shows the V/L ratios for the calibrated readings of the gauge 80 for six ⅛" diameter apertures 52 in the cylinder 48 and the seconds required to disperse one gallon of gasoline. It should be understood that the elements of this embodiment can be utilized in other ways to ascertain the V/L ratio, and that the chart in FIG. 10 can take other forms to achieve the same results.

The embodiment shown in FIGS. 7, 8 and 9 is similar to the previous embodiment except it uses a positive displacement type meter 84. The positive displacement type meter 84 registers the total volume of ambient air drawn in by the vapor recovery system through the meter 84. The meter 84 does not require the cylinder of the test sleeve 36 to have apertures as were required in the previous embodiment. Accordingly, FIG. 8 illustrates a cylinder 86 which has no apertures except the one to which the fitting 72 is connected which communicates the chamber 50 to the meter 84. The operating procedure for this embodiment is to dispense a quantity of gasoline which will be registered on the gauge 24 in total gallons. The meter 84 is then read which may indicate the total air volume in cubic feet. If so, this amount would be multiplied by 7.48 to give the equivalent volume of gasoline vapor in gallons. The equivalent total volume of gasoline vapor is then divided by the total volume of gasoline dispensed to provide the V/L ratio. A stop watch is not required for this procedure. However, it may be used if data is desired as to the rate of flow of gasoline dispensed for a particular V/L ratio.

Figure 11:
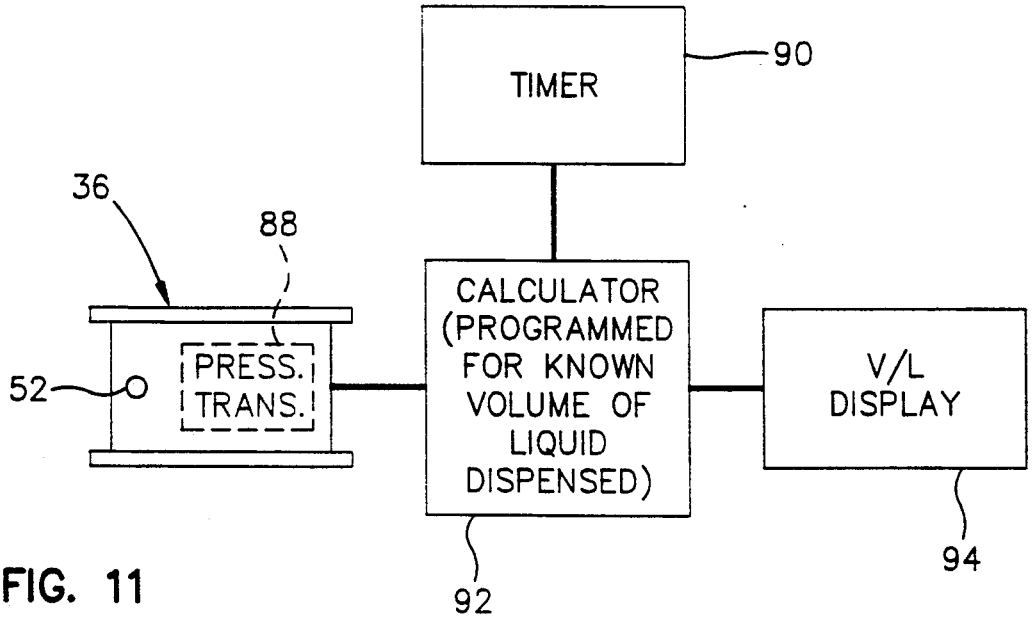
FIG. 11 is a block diagram illustrating an exemplary arrangement for automatically indicating the V/L ratio of a vapor recovery system.

An exemplary system for automatically displaying the V/L ratio is illustrated in FIG. 11. This system may include a pressure transducer 88, which is mounted in the test sleeve 36, and a timer 90, which provides an indication of lapsed time from the beginning of dispensing gasoline to the end thereof. The pressure transducer 88 and the timer 90 may provide pressure and time signals to a calculator 92. The calculator can be programmed to determine the rate of vapors vacuumed from the pressure signal and rate of gasoline dispensed from the time signal, the latter rate being based upon a known volume of gasoline, such as one gallon. With this arrangement the operator would dispense the known volume of gasoline. If the calculator is programmed for one gallon of gasoline, the operator would dispense one gallon of gasoline, starting and stopping the timer 90 at the beginning and end of the dispensing. One gallon then becomes the L part of the V/L ratio. The calculator 92 uses the signal from the pressure transducer 88 and the elapsed time signal from the timer 90 to calculate the V/L ratio. The calculator 92 can then send a signal to a display 94 which will provide a direct readout of the V/L ratio.

In both embodiments, the procedures can be run while filling the tank 44 of a vehicle. This is accomplished by utilizing the extender 38. The advantage of this procedure is that there is no need for a fill container to catch the gasoline dispensed during the test. The operator simply fills a gasoline tank with the invention attached. However, it is to be understood that the invention can be practiced without the extender 38, in which case, the gasoline dispensed must be captured by a separate tank or container. In such an instance, the extender would be simply laid aside and the spout would be directed into the tank or container for dispensing the gasoline and making the necessary readings. One of the features, however, of the invention is that the gasoline can be dispensed into an ordinary vehicle tank while conducting the test procedures. This overcomes the problem of disposing of the gasoline after the test.

The method of the invention is illustrated by the operation of the embodiment shown in FIGS. 4, 5 and 6, or the embodiment shown in FIGS. 7, 8 and 9. In reference to the first embodiment, for example, the method would include sealing portions of the spout 26 on both sides of the vapor recovery apertures 32 so as to form the chamber 50 about the apertures 32, as illustrated in FIG. 6. The flow through the chamber 50 is sensed by an instrument such as the meter 74 in FIG. 4. The method may further include dispensing a specified volume of gasoline over a period of time and then calculating from the volume of gasoline, the time and the flow ratio of the volume of ambient air recovered to the volume of gasoline dispensed. To avoid the use of separate tank or container, the method may further include extending the end of the spout 26 and then inserting the extended spout into a vehicle gasoline inlet. This may be accomplished by the extender 38, illustrated at FIG. 4, which is inserted as shown.

As stated hereinabove, the invention can be utilized for measuring the efficiency of a vapor recovery system which is part of a liquid dispensing system. While gasoline was referred to as the liquid, it should be realized that any liquid and vapor volumes can be measured by the invention.

Although the invention has been described in terms of the specific embodiments, it is possible that modifications and substitutions to various components of the invention would occur to the person of ordinary skill in the art, and therefore, would be within the scope of the invention, which is to be limited only by the claims which follow.

What is claimed is:

1. A device for testing the performance of the vapor recovery of a liquid dispensing and vapor recovery system of the type which has a spout with vapor recovery apertures, the device comprising;

spout receiving means for receiving the spout and its vapor recovery apertures with space located between the spout and said spout receiving means;

sealing means connected to said spout receiving means for providing a chamber which encloses said space and which is sealed about the vapor recovery apertures; and means connected to said spout receiving means for sensing air flow through said chamber about the vapor recovery apertures;

whereby a volume of air recovered can be determined and compared with a volume of liquid dispensed to indicate the performance of the vapor recovery system.

2. The vapor recovery testing device recited in claim 1, and further comprising means adapted to sealably receive a distal end portion of the spout for extending the liquid dispensing outlet thereof.

3. The vapor recovery testing device recited in claim 1, wherein the air flow sensing means comprises a positive displacement air volume meter.

4. The vapor recovery testing device recited in claim 1, wherein said spout receiving means includes at least one aperture which opens said chamber to the atmosphere.

5. The vapor recovery testing device recited in claim 4, wherein the air flow sensing means comprises an orifice type meter.

6. The vapor recovery testing device recited in claim 1, wherein:

said spout receiving means includes a hollow cylinder which has oppositely located end portions; and said sealing means includes a pair of flexible rings, each ring being connected to a respective cylinder end portion and extending radially inwardly therefrom to engage and seal about the spout.

7. The vapor recovery testing device recited in claim 6, wherein the air flow sensing means comprises a positive displacement air volume meter.

8. The vapor recovery testing device recited in claim 6, wherein;

said tube has at least one aperture which opens the chamber to the atmosphere; and the air flow sensing means including an orifice type meter.

9. The vapor recovery testing device recited in claim 8, wherein said rings are resilient.

10. The vapor recovery testing device recited in claim 9, and further comprising a tube adapted to sealably receive a distal end portion of the spout for extending the liquid dispensing outlet thereof.

11. The vapor recovery testing device recited in claim 1, and further comprising means connected to the air flow sensing means and responsive to air flow through the sealed chamber, the volume of liquid dispensed and an elapsed time between on and off modes of the liquid dispensing system, for calculating a V/L ratio, where V is an equivalent volume of gasoline vapor recovered and L is the volume of liquid dispensed.

12. The vapor recovery testing device recited in claim 11, and further comprising means connected to said calculating means for displaying the V/L ratio.

13. The vapor recovery testing device recited in claim 11, wherein said air flow sensing means includes a pressure transducer, said pressure transducer being connected to said spout receiving means for producing a signal indicative of the pressure within said chamber, the device further comprising;

timing means for producing a signal indicative of the elapsed time between on and off modes of the liquid dispensing system, the calculating means being connected to said pressure transducer and said timing means for receiving their signals, said calculating means being programmed with a constant volume signal of liquid dispensed for calculating the constant volume signal and the received signals to produce a V/L ratio signal; and means connected to said calculating means for receiving the V/L ratio signal and for producing a display indicative thereof.

14. A vapor recovery system testing sleeve for use on a liquid dispensing and vapor recovery spout of the type which has vapor recovery apertures comprising:

spout receiving means for receiving the spout and its vapor recovery apertures with space located between the spout and said spout receiving means;

sealing means connected to said spout receiving means for providing a chamber which encloses said space and which is sealed about the vapor recovery apertures; and fitting means connected to said spout receiving means and adapted to open into said chamber for connection to an air flow sensing means.

15. The vapor recovery system testing sleeve recited in claim 14, wherein, said spout receiving means has at least one aperture which opens the chamber to the atmosphere.

16. The vapor recovery system testing sleeve recited in claim 15, wherein:

said spout receiving means includes a cylinder which has oppositely located end portions; and said sealing means comprises a pair of resilient rings, each ring being connected to a respective one of said cylinder end portions and extending radially inwardly therefrom to engage and seal about the spout.

17. A method of conducting a test of the performance of the vapor recovery of a liquid dispensing system, the system having a liquid dispensing and vapor recovery spout which has vapor recovery apertures, the method comprising the steps of:

sealing portions of the spout on both sides of the vapor recovery apertures so as to form a chamber therearound about the vapor recovery apertures; and sensing air flow through the chamber.

18. The method recited in claim 17 and comprising the further steps dispensing a volume of liquid over a period of time; and calculating from the volume of liquid, the time and a sensed air flow a ratio of an equivalent volume of vapor recovered to the volume of liquid dispensed.

19. The method recited in claim 18, and comprising the further steps of:

mounting an extended spout portion to a distal end portion of the spout; and inserting the extended spout portion into a vehicle inlet.

* * * * *